US006170568B1

(12) United States Patent
Valenzuela

(10) Patent No.: US 6,170,568 B1
(45) Date of Patent: Jan. 9, 2001

(54) RADIAL FLOW HEAT EXCHANGER

(75) Inventor: Javier Valenzuela, Hanover, NH (US)

(73) Assignee: Creare Inc., Hanover, NH (US)

( * ) Notice: Under 35 U.S.C. 154(b), the term of this patent shall be extended for 0 days.

(21) Appl. No.: 09/054,295

(22) Filed: Apr. 2, 1998

Related U.S. Application Data

(60) Provisional application No. 60/043,367, filed on Apr. 2, 1997.

(51) Int. Cl.[7] ..... F28F 3/08

(52) U.S. Cl. ..... 165/167; 165/166; 165/DIG. 357

(58) Field of Search ..... 165/166, 167

(56) References Cited

U.S. PATENT DOCUMENTS

| | | | | |
|---|---|---|---|---|
| 840,667 | | 1/1907 | Speed et al. . | |
| 884,600 | | 4/1908 | Moreau . | |
| 2,251,066 | * | 7/1941 | Persson et al. | 165/167 |
| 2,281,754 | | 5/1942 | Dalzell | 257/245 |
| 2,428,880 | | 10/1947 | Kintner | 257/245 |
| 2,596,008 | | 5/1952 | Collins | 257/245 |
| 2,677,531 | * | 5/1954 | Hock, Sr. et al. | 165/167 |
| 2,865,613 | | 12/1958 | Egenwall et al. | 257/245 |
| 4,081,025 | | 3/1978 | Donaldson | 165/140 |
| 4,516,632 | * | 5/1985 | Swift et al. | 165/167 |
| 4,535,840 | * | 8/1985 | Rosman et al. | 165/167 |
| 4,919,200 | | 4/1990 | Glomski et al. | 165/166 |
| 4,974,413 | * | 12/1990 | Szego | 165/166 X |
| 5,078,209 | | 1/1992 | Kerkman et al. | 165/167 |
| 5,291,945 | | 3/1994 | Blomgren et al. | 165/167 |
| 5,462,113 | | 10/1995 | Wand | 165/167 |
| 5,544,703 | | 8/1996 | Joël et al. | 165/167 |

* cited by examiner

*Primary Examiner*—Allen Flanigan
(74) *Attorney, Agent, or Firm*—Downs Rachlin & Martin PLLC

(57) ABSTRACT

A radial flow heat exchanger (20) having a plurality of first passages (24) for transporting a first fluid (25) and a plurality of second passages (26) for transporting a second fluid (27). The first and second passages are arranged in stacked, alternating relationship, are separated from one another by relatively thin plates (30) and (32), and surround a central axis (22). The thickness of the first and second passages are selected so that the first and second fluids, respectively, are transported with laminar flow through the passages. To enhance thermal energy transfer between first and second passages, the latter are arranged so each first passage is in thermal communication with an associated second passage along substantially its entire length, and vice versa with respect to the second passages. The heat exchangers may be stacked to achieve a modular heat exchange assembly (300). Certain heat exchangers in the assembly may be designed slightly differently than other heat exchangers to address changes in fluid properties during transport through the heat exchanger, so as to enhance overall thermal effectiveness of the assembly.

43 Claims, 8 Drawing Sheets

RADIAL FLOW HEAT EXCHANGER

The present application claims priority based on U.S. Provisional Application Ser. No. 60/043,367, filed Apr. 2, 1997, in the name of Javier A. Valenzuela.

This invention was made with Government support under Grant No. DE-FG02-93ER81537 awarded by the Department of Energy and Contract No. NAS5-33228 awarded by the National Aeronautics and Space Administration. The Government has certain rights in this invention.

FIELD OF THE INVENTION

The present invention relates to plate-type heat exchangers and, more particularly, to radial flow plate-type heat exchangers.

BACKGROUND OF THE INVENTION

Reverse-Brayton cryocoolers use a recuperative heat exchanger to cool the high pressure gas with the cold, low pressure gas returning from the cold end. In typical reverse-Brayton cryocoolers having plate-fin design, the energy transfer in the heat exchanger is an order of magnitude or more greater than the overall cryocooler input power. Therefore, losses in the heat exchanger have a strong influence on the total input power required.

Input power reduction can be achieved by increasing the thermal effectiveness (ratio of temperature difference between the incoming and outgoing first fluid streams to temperature difference between incoming first and second fluid streams) of the heat exchanger. Unfortunately, with known plate-fin heat exchangers, it is difficult to achieve effectiveness levels in excess of about 96–97%. By increasing effectiveness to 99% or more and reducing the pressure drop ratio (pressure loss divided by system pressure) to 0.02, the input power to the cryocooler could likely be reduced by a factor of 2. In plate-type heat exchangers, it is known to form multiple concavo-convex structures, i.e., "dimples," in the sheets of material used to manufacture fluid channels in the heat exchanger. See, for example, the heat exchangers in U.S. Pat. Nos. 2,281,754 to Dalzell and 2,596,008 to Collins. These dimples provide mechanical integrity to the fluid channels. In addition, these dimples are provided for the purpose of inducing turbulent flow in the fluid channels so as to enhance convective heat transfer.

Plate-type heat exchangers have fluid channels arranged so that different fluids in adjacent channels flow in the same direction (i.e., have parallel flow fluid paths), flow in opposite directions (i.e., have counterflow fluid paths), flow in transverse directions (i.e., transverse flow fluid paths) or have a combination of these fluid flow paths. In yet another class of plate-type heat exchangers, different fluids are transported in a circumferential flow about a central axis. U.S. Pat. No. 840,667 to Speed et al. describes a circumferential, counterflow heat exchanger, and U.S. Pat. No. 5,078,209 describes a circumferential flow heat exchanger featuring both parallel flow and counterflow fluid paths.

Known recuperative plate-type heat exchangers typically include structures such as fins and plates made from a material, e.g., aluminum, having a relatively high thermal conductivity. Such structures are often configured and positioned so as to provide a relatively low resistance thermal conductivity path between inlet and outlet for a given fluid circuit. In view of these attributes of known plate-type heat exchangers, heat exchange effectiveness is typically not as high as desired.

For a given heat exchanger application, a number of design parameters, such as fluid path height and length, need to be addressed in designing an appropriate heat exchanger. When fluid properties change significantly during travel through the heat exchanger, it may be necessary to change one or more of these design parameters at various regions of the heat exchanger to maintain optimal performance. Together, these factors virtually necessitate original design of a heat exchanger for a given application, particularly when simultaneous high heat transfer effectiveness and low pressure losses are desired. Such original design adds to the time and cost associated with implementing a heat exchanger in a given application.

BRIEF DESCRIPTION OF THE DRAWINGS

For a fuller understanding of the present invention, reference should be made to the following detailed description taken in connection with the following drawings wherein.

SUMMARY OF THE INVENTION

Figure 1:
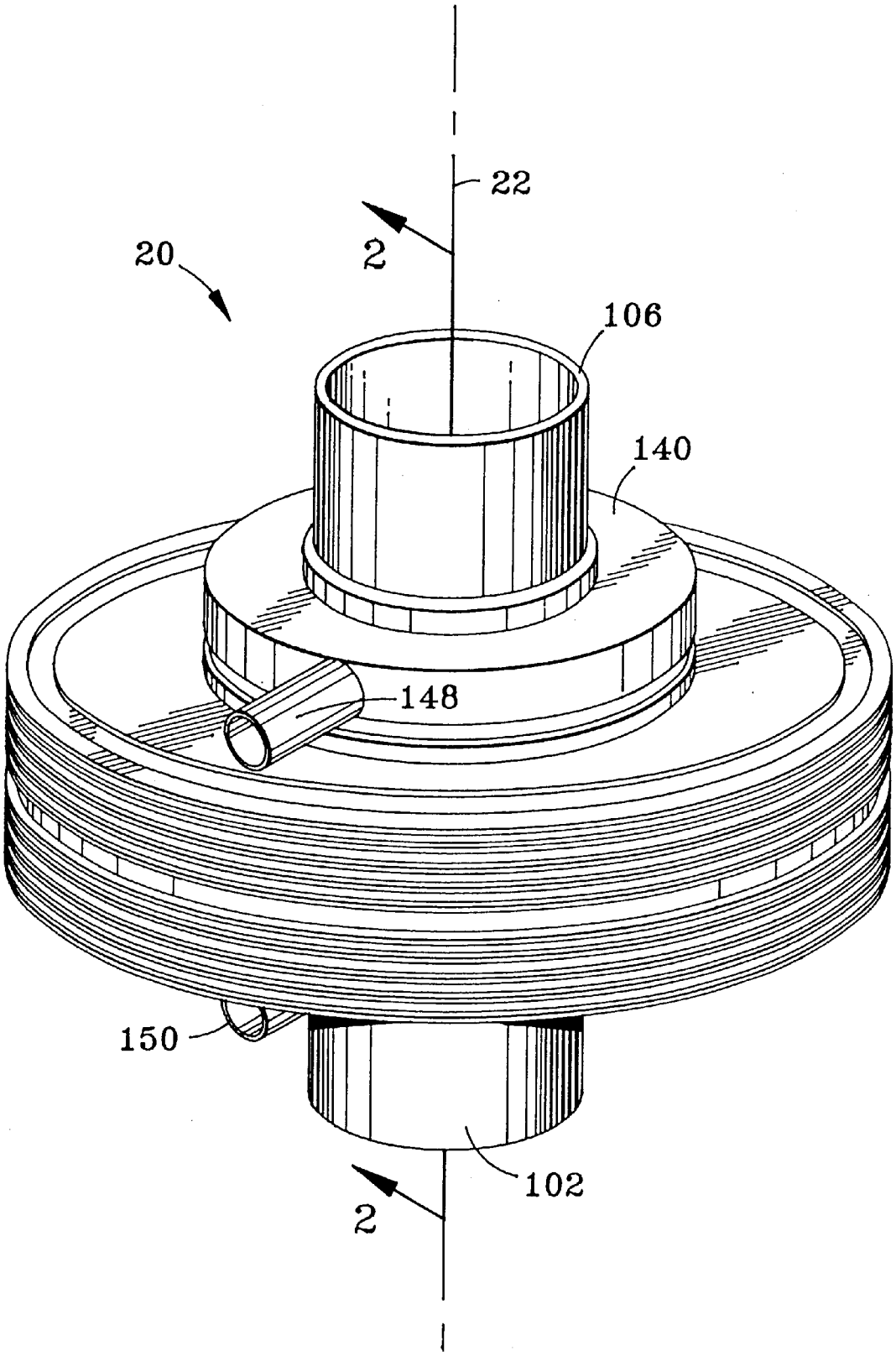
FIG. 1 is a perspective view of the radial flow heat exchanger of the present invention.

The present invention is a radial flow heat exchanger having a longitudinal axis, a plurality of first passages for transporting a first fluid and a plurality of second passages for transporting a second fluid. The plurality of first passages surround and extend radially relative to the longitudinal axis and the plurality of second passages surround and extend radially relative to the longitudinal axis.

Another aspect of the present invention is a radial flow heat exchanger comprising a longitudinal axis, a plurality of first passages for transporting a first fluid and a plurality of second passages for transporting the first fluid. The first and second passages surround and extend radially relative to the longitudinal axis. In addition, the heat exchanger includes a plurality of third passages for transporting a second fluid and a plurality of fourth passages for transporting the second fluid. The third and fourth passages surround and extend radially relative to the longitudinal axis.

Yet another aspect of the present invention is a heat exchanger comprising structure defining first passages through which a first fluid may flow and second passages through which a second fluid may flow. The structure has a thermal conductivity of less than 20 Watts/meter-K, and the heat exchanger has a thermal effectiveness of at least 97%.

Still another aspect of the present invention is a heat exchanger comprising a first passage through which a first fluid may be transported and a second passage through which a second fluid may be transported. The second passage is in thermal communication with the first passage and the first and second passages each have a height δ that is less than 2 mm. In addition, the height δ of each of said first and second passages preferably satisfies the constraint $$\delta < \frac{\mu Re_t}{2\rho u},$$

wherein

ρ is the density of the fluid (kg/m$^3$), u is the local velocity of the fluid (m/s), $\mu$ is the viscosity of the fluid (Pa-s), and $Re_t$ is the Reynolds number that corresponds to the laminar/turbulent transition for fluid transported in the first passage and in said second passage.

Another aspect of the present invention is a modular heat exchange assembly comprising a first heat exchanger having a plurality of first fluid passages for transporting a first fluid and a plurality of second fluid passages for transporting a second-fluid. The plurality of first fluid passages have a height $\delta_1$ and the plurality of second fluid passages have a height $\delta_2$. The assembly also includes a second heat exchanger having a third fluid passage for transporting the first fluid and a fourth fluid passage for transporting the second fluid. The plurality of third fluid passages have a height $\delta_3$ and plurality of fourth fluid passages have a height $\delta_4$. Coupling means are provided for fluidly coupling the first fluid passage and the third fluid passage and for fluidly coupling the second fluid passage and the fourth fluid passage, when the first heat exchanger and the second heat exchanger are positioned in mating relationship. In addition, at least one of (i) the heights $\delta_1$, $\delta_2$, $\delta_3$ and $\delta_4$, (ii) the number of the plurality of first fluid passages and the number of the plurality of third fluid passages, (iii) the number of the plurality of second fluid passages and the number of the plurality of fourth fluid passages, (iv) materials used in constructing the first heat exchanger and materials used in constructing the second heat exchanger, are different.

DETAILED DESCRIPTION OF THE INVENTION

Figure 2:
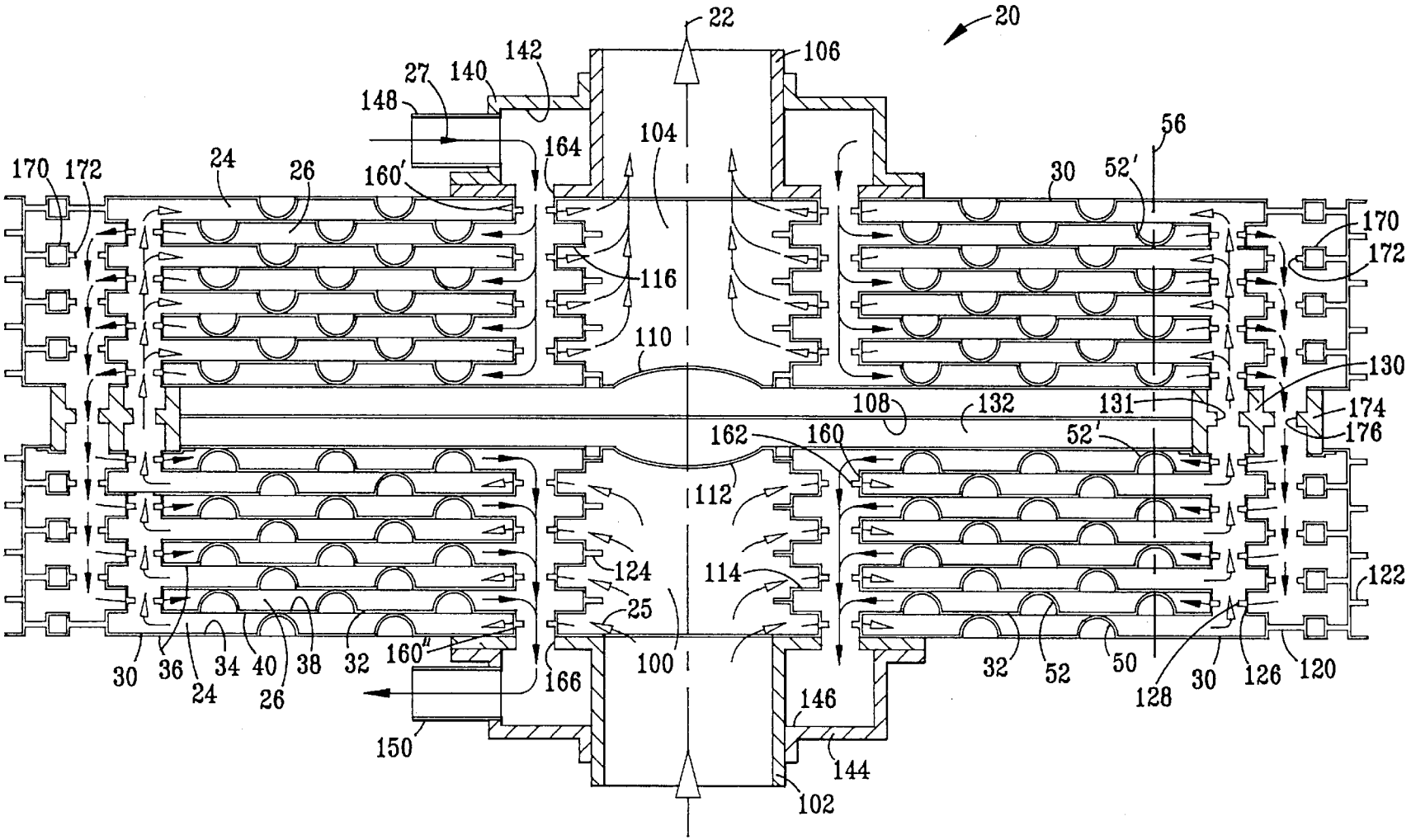
FIG. 2 is a cross-sectional view of the heat exchanger of FIG. 1, taken along line 2—2 in FIG. 1.

Referring to FIGS. 1 and 2, one aspect of the present invention is a radial flow heat exchanger 20 having a central axis 22. Heat exchanger 20 includes a plurality of first passages 24 through which a first fluid 25 (identified by arrows with open heads) may be transported and a plurality of second passages 26 through which a second fluid 27 (identified by arrows with closed heads) may be transported. First passages 24 and second passages 26 surround central axis 22, and extend radially outwardly relative to the central axis. Also, first passages 24 and second passages 26 are positioned in alternating, i.e., interleaved, stacked relationship so that each first passage 24 is positioned between two adjacent second passages 26, as measured along an axis extending parallel to axis 22, except for the outermost passages 24. The number of first passages 24 and second passages 26 used will vary depending upon flow rates, materials used, fluid properties, and performance requirements. However, in the embodiment of heat exchanger 20 illustrated in FIGS. 1 and 2, eight first passages 24 and eight second passages 26 are provided. As used in the following description of the present invention, the terms "upper," "lower," "above," "below" and the like are used to facilitate description, and do not represent absolute location of structure described using these terms.

Heat exchanger 20 also includes a plurality of plates 30 and 32, which are stacked in alternating relationship. Plate 30 has an inner surface 34 and an outer surface 36. Plate 32 has an inner surface 38 and an outer surface 40. Each first passage 24 is defined by inner surface 34 of plate 30 and outer surface 40 of plate 32. Each second passage 26 is defined by inner surface 38 of plate 32 and outer surface 36 of plate 30. Plates 30 and 32 are arranged so their surfaces 34, 36, 38 and 40 extend radially relative to central axis 22, and preferably, but not necessarily, these surfaces extend orthogonally relative to the central axis. In addition, plates 30 and 32 preferably, extend in parallel.

Plates 30 and 32 are preferably circular, although oval and other configurations are encompassed by the present invention. The radius R (FIG. 3) of plate 30, and the radius (not labeled) of plate 32, which is typically the same as radius R of plate 30, depend upon the relative temperature s and pressures of the fluids in first passages 24 and second passages 26, the desired overall thermal effectiveness of heat exchanger 20, the desired pressure loss in the heat exchanger, fluid properties of the fluids transported in the heat exchanger, and materials used in the construction of the heat exchanger. However, preferably radius R, which is the same as the radius for plate 32, falls in the range 2 cm to 50 cm. In one embodiment of the present invention plates, 30 and 32 each have a radius of about 6 cm.

Plates 30 and 32 may be made from any formable metal such as stainless steel, titanium, nickel alloys, aluminum and copper. To minimize flow direction thermal (i.e., streamwise) conductivity, materials having a relatively low thermal conductivity, i.e., less than about 20 Watts/meter-K, are preferred. For these reasons, it is also preferable to make plates 30 and 32 relatively thin, i.e., having a thickness in the range 50 $\mu$m to 250 $\mu$m.

Turning now to FIGS. 1–4, plate 30 preferably includes a plurality of dimples 50, and plate 32 preferably includes a plurality of dimples 52. Dimples 50 and 52 have a concavo-convex configuration. Dimples 50 are formed in plates 30 so as to extend from inner surface 34 of plates 30 to outer surface 40 of adjacent plates 32, and dimples 52 are formed in plates 32 so as to extend from inner surface 38 of plates 32 to outer surface 36 of plates 30.

Figure 3:
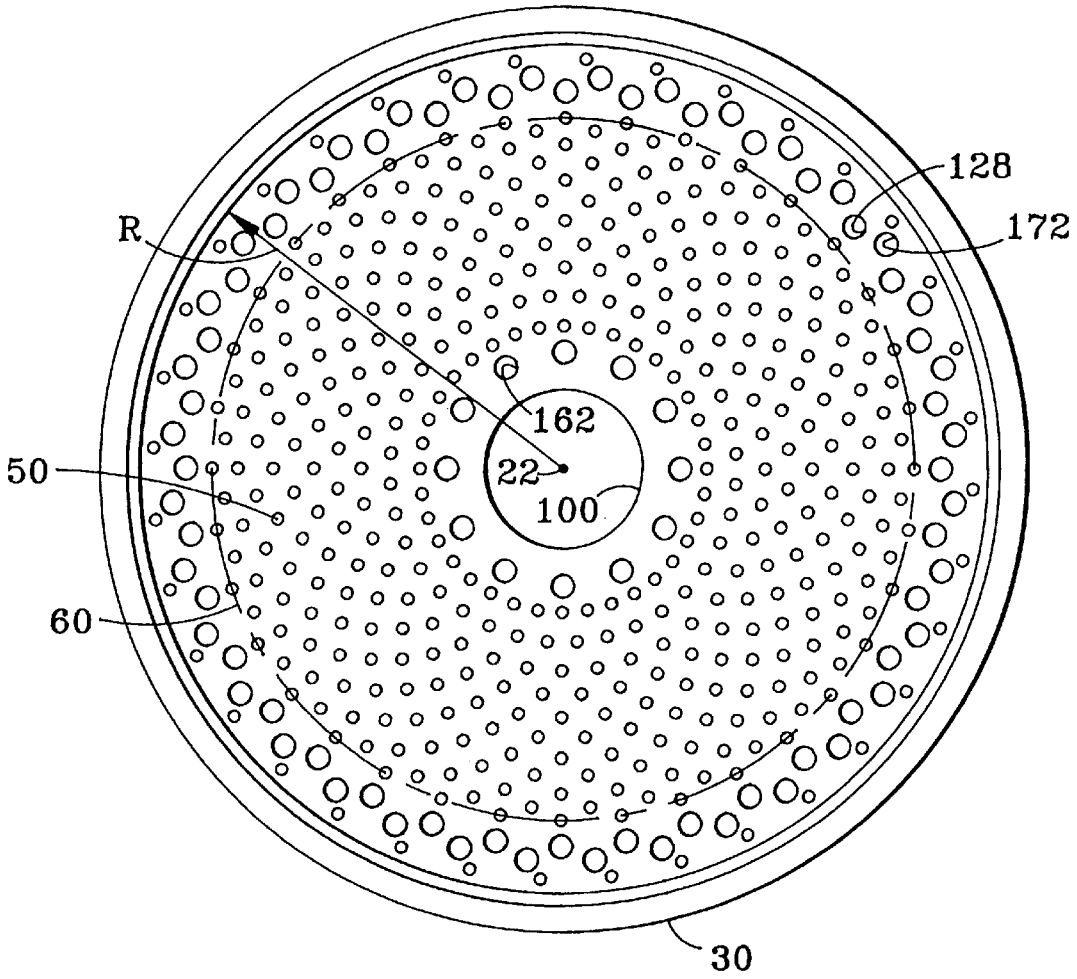
FIG. 3 is a plan view of one plate of the heat exchanger of FIG. 1.

Preferably, dimples 50 and dimples 52 are arranged in a regular order, with the optimal order varying as a function of the fluid pressures, material characteristic and other factors, as discussed in more detail below. However, it is generally preferred that dimples 50 in a given plate 30 be laterally offset, i.e., not aligned along axes extending parallel to axis 22, relative to dimples 52 in the plate 30 immediately adjacent the given plate 30. It also generally preferred that a given dimple 50 or 52 in one plate 30 or 32, respectively, be aligned along an axis extending parallel to axis 22 with respect associated dimples in the other plates 30 and 32 in heat exchanger 20. For example, dimples 52' are aligned along axis 56 (see FIG. 2). Referring to FIG. 3, in addition it is generally preferred that dimples 50 be arranged in concentric rings 60, with the spacing between dimples 50 in any one of the rings being equal. Although not illustrated in plan view, dimples 52 are similarly arranged and spaced.

Figure 4:
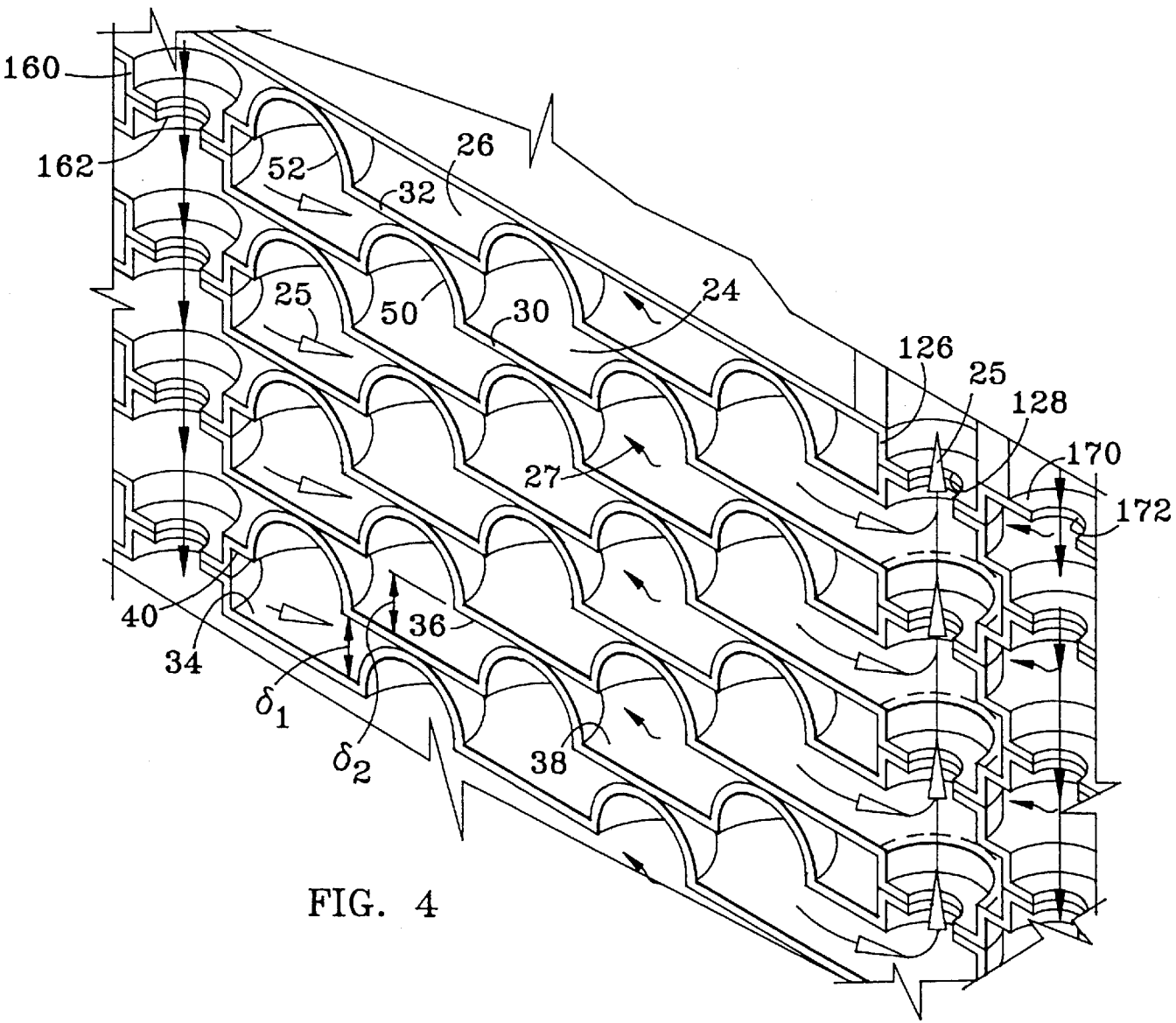
FIG. 4 is an exploded, partial, perspective view of the heat exchanger of FIG. 1 showing the boss structure coupling fluid channels of like fluid type.

The diameter of dimples 50 and 52 is selected as a function of fluid pressures, fluid properties, materials characteristics and other application and design parameters of heat exchanger 20. In general, however, the diameter of dimples 50 and 52, as measured at the widest point of the dimples, preferably ranges from 0.5 mm to 2 mm, with about 1 mm being preferred. In addition, the height of dimples 50 and 52 is selected so that passages 24 have a height $\delta_1$ and passages 26 have a height $\delta_2$ (FIG. 4). With respect to passage 24 this height $\delta_1$ is measured between inner surface 34 of plate 30 and outer surface 40 of plate 32, along an axis extending perpendicular to surfaces 34 and 40. With respect to passage 26 this height $\delta_2$ is measured between inner surface 38 of plate 32 and outer surface 36 of plate 30, along an axis extending perpendicular to surfaces 36 and 38. Typically, the height $\delta_1$ of passages 24 is the same as the height $\delta_2$ of passages 26, although in some applications it may be desirable to vary the height in a given heat exchanger 20. To achieve these heights $\delta_1$ and $\delta_2$, the height of dimples 50 and 52, and hence heights $\delta_1$ and $\delta_2$ are preferably in the range of 0.05–3.0 mm, more preferably in the range 0.1–0.5 mm, but in any event is preferably selected so that both heights $\delta_1$ and $\delta_2$ satisfy the condition:

$$\delta < \frac{\mu Re_t}{2\rho u},$$

wherein

- $\rho$ is the density of the fluid in the flow passage (kg/m$^3$),
- u is the local velocity of the fluid in the flow passage (m/s),
- $\mu$ is the viscosity of the fluid in the flow passage (Pa-s), and
- $Re_t$ is the Reynolds number that corresponds to the laminar/turbulent transition for a given fluid and flow passage geometry.

For example, in connection with one embodiment of the present invention intended to transport a fluid having a density $\rho$ of 7.3 kg/m$^3$ and a viscosity $\mu$ of $1.4\times10^{-5}$ Pa-s, at a local velocity u of 0.5 m/s, and where the Reynolds number $Re_t$ for the fluid's laminar/turbulent flow transition is 1500, $$\frac{\mu Re_t}{2\rho\mu} = \frac{1.4\times10^{-5}\ \text{Pa-s}\ (1500)}{(2)(7.3\ \text{kg/m}^3)(0.5\ \text{m/s})} = 2.9\ \text{mm}$$

In this example the constraint $$\delta < \frac{\mu Re_t}{2\rho u}$$

is clearly satisfied.

Regardless of the height of dimples 50 and 52 selected, it is important the heights $\delta_1$ and $\delta_2$ be maintained within a relatively close tolerance, i.e., ±0.001 mm. This is necessary so as to ensure a high degree of uniformity in spacing between adjacent plates 30 and 32, given that this spacing is determined by the height of dimples 50 and 52.

The overall thickness of heat exchanger 20, as measured along axis 56 between the outermost outer surfaces 36 or 40, as the case may be, will depend upon heights $\delta_1$ and $\delta_2$, and the number and thickness of plates 30 and 32 and other factors selected in designing the heat exchanger. In one embodiment of the present invention, this thickness is about 1 cm.

The number of dimples 50 and 52 is selected primarily as a function of the fluid pressures in passages 24 and 26, with more dimples being required as pressures increase. Typically, however, a sufficient number of dimples 50 and 52 is provided so that the lateral spacing, i.e., spacing as viewed in FIG. 2, between any two dimples 50 and 52 preferably ranges from 2 mm to 6 mm.

The crown or top of each dimple 50 is secured to outer surface 40 of plate 32 by brazing or other appropriate technique. Using similar attachment means, the crown or top of each dimple 52 is secured to outer surface 36 of each plate 30. As a result of this attachment, each plate 30 is attached in a defined, spaced relationship to two immediately adjacent plates 32 (except outermost plates 30 are attached to a single plate 32). Tab or alignment marks (not shown) are typically provided on the periphery of each plate to assist in proper assembly.

In selecting the thickness of plates 30 and 32, the number of dimples 50 and 52 to be used, and the strength of the braze or other attachment means used to secure the dimples to adjacent plates, the pressure of the fluids to be transported in passages 24 and 26 needs to be addressed. As those skilled in the art will appreciate, these features can be selected empirically, mathematically, or by combination of both. In one embodiment of the present invention, plates 30 are made from stainless steel having an electroless nickel (P/Ni alloy) plating and a thickness of 75 $\mu$m and dimples 50 and 52 have a diameter of 1 mm, a height of 0.250 mm and are laterally spaced 5 mm from adjacent dimples, and dimples 50 and 52 are brazed to plates 32 and 30, respectively, using the plated layer of P/Ni braze. In this embodiment fluid pressures well in excess of a typical operating pressure of 3 atm can be accommodated: By appropriate selection of heights $\delta_1$ and $\delta_2$, number and spacing of dimples 50 and 52, and other factors, pressures up to about 40 atm can be accommodated in passages 24 and 26.

Heat exchanger 20 includes a lower plenum 100 fluidly coupled with inlet port 102 and an upper plenum 104 fluidly coupled with outlet port 106. Plenums 100 and 104 are fluidly isolated from one another by plate 110 positioned at the lower end of plenum 104 and by plate 112 positioned at the upper end of plenum 100. The volume between plates 110 and 112 is preferably in vacuum, so that passages 24 and 26 above and below a mid-plane (not shown) extending perpendicular to central axis 22 and extending along plate 108 are thermally isolated from one another. Also, central plate 108 may be included as an optional radiation shield to further limit heat transfer across the mid-plane. First passages 24 are fluidly coupled with plenum 100 via inlets 114 at the radially innermost extent of the first passages, and are coupled with plenum 104 via outlets 116 at the radially innermost extent of the first passages. Each first passage 24 is sealed at its radially outermost end by folding portions of plates 30 and 32 and then brazing them together to form sealing structure 120 (FIG. 2). Each second passage 26 is sealed at its radially outermost end by folding portions of adjacent sealing structures 120 and then brazing them together to form sealing structures 122 (FIG. 2). Each second passage 26 is sealed at its radially innermost end by folding portions of plates 30 and 32, and then brazing them together to form sealing structures 124 (FIG. 2).

First passages 24 are fluidly coupled with one another at radially outer locations via annular bosses 126 provided in radially outer portions of passages 26. Each boss 126 includes an internal aperture 128 (FIGS. 2 and 4) which fluidly couples first passages 24 to adjacent first passages 24 and bosses 126. When the plates are brazed together, a fluid-tight seal is made around aperture 128. Bosses 126 are designed to prevent second fluid 27 in second passages 26, through which the bosses extend, from entering apertures 128, and hence first passages 24. A central manifold 130 having an internal aperture 131 is provided extending across mid-section 132 of heat exchanger 20. Central manifold 130, via its internal aperture 131, fluidly couples bosses 126 immediately below and immediately above mid-section 132, and thereby transports first fluid 25 in first passages 24 across the mid-section. Central manifold 130 may be replaced, in a different embodiment, by suitable embossments (not shown) formed in radially outer portions of plates 110 and 112 that are brazed together to form a fluid tight structure.

Heat exchanger 20 also includes an annular inlet manifold 140 having an annular interior 142, and an annular outlet manifold 144 having an annular interior 146. Inlet manifold 140 includes an inlet port 148 fluidly coupled with interior 142 and outlet manifold 144 includes an outlet port 150 fluidly coupled with interior 146

Second passages 26 are fluidly coupled with one another at radially inner locations via annular bosses 160 provided in radially inner portions of passages 24. Each boss 160 includes an internal aperture 162 (FIGS. 2 and 4) which fluidly couples second passages 26 to adjacent second passages 26 and bosses 160. When the plates are brazed together, a fluid-tight seal is made around aperture 162. Bosses 160 are designed to prevent first fluid 25 in first passages 24, through which the bosses extend, from entering apertures 162, and hence second passages 26. Each boss 160' (positioned adjacent interior 142 of inlet manifold 140;

see FIG. 2) is fluidly coupled with interior 142 via one of a plurality of apertures 164 (FIGS. 2 and 3). Similarly, each boss 160" (positioned adjacent interior 146 of outlet manifold 144; see FIG. 2) is fluidly coupled with interior 146 via one of a plurality of apertures 166 (FIG. 2).

Second passages 26 are also fluidly coupled with one another at radially outer locations via annular bosses 170 provided in radially outer portions of first passages 24. Each boss 170 includes an internal aperture 172 (FIGS. 2 and 4) which fluidly couples second passages 26 to adjacent second passages 26 and bosses 170. When the plates are brazed together, a fluid-tight seal is made around aperture 172. Bosses 170 are designed to prevent first fluid 25 in first passages 24, through which the bosses extend, from entering apertures 172, and hence second passages 26. A central manifold 174 having an internal aperture 176 is provided, extending across mid-section 132 of heat exchanger 20. Central manifold 174, via its internal aperture 176, fluidly couples bosses 170 and passages 26 immediately below and immediately above mid-section 132, and thereby transports fluid in second passages 26 across the mid-section. Central boss 174 may be replaced, in a different embodiment, by suitable embossments (not shown) formed in radially outer portions of plates 110 and 112 that are brazed together to form a fluid tight structure.

Figure 5:
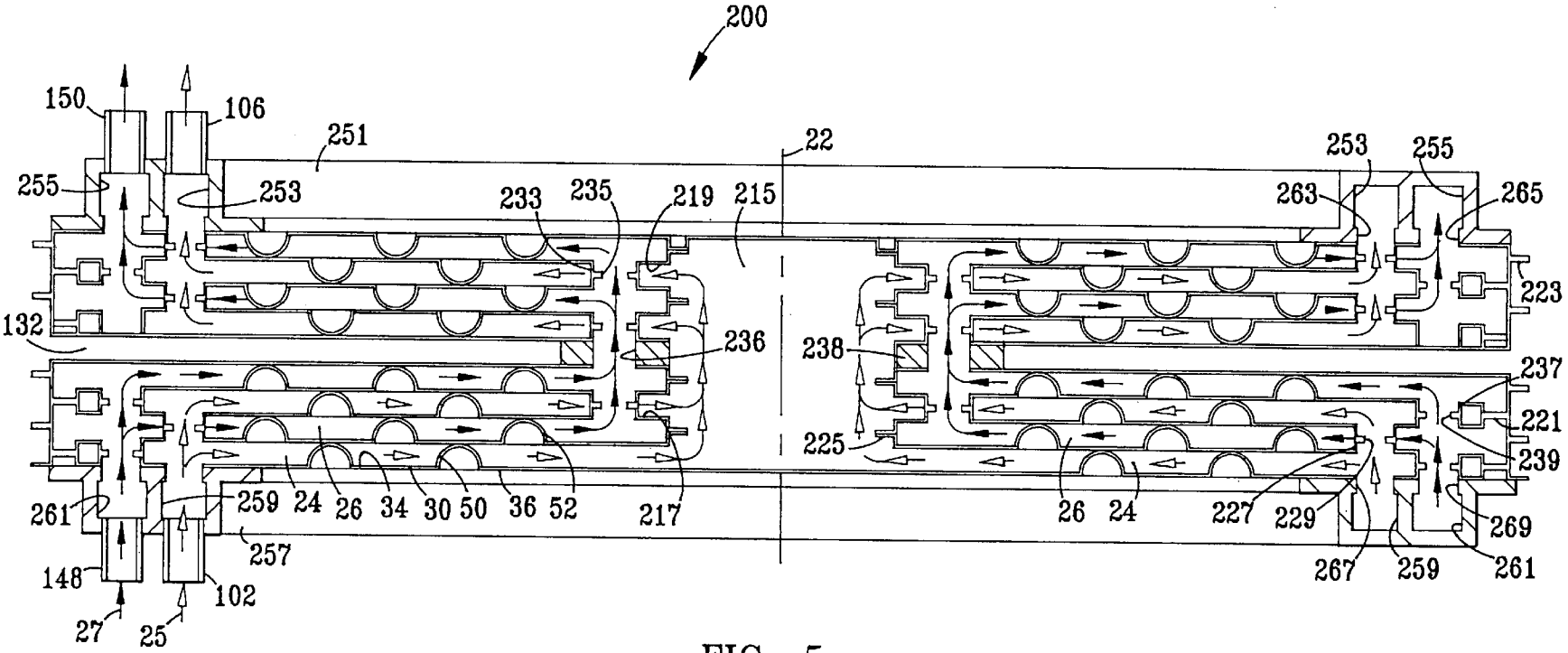
FIG. 5 is a cross-sectional view, similar to FIG. 2, of a second embodiment of the heat exchanger of the present invention.

In another embodiment of the heat exchanger of the present invention, identified as heat exchanger 200 in FIG. 5, fluids are introduced to and removed from the heat exchanger at a peripheral location, rather than a central location as is the case with heat exchanger 20. In the following description of heat exchanger 200, only a brief description is provided of structure that has an identical counterpart in heat exchanger 20, with common reference numbers being used for such identical structure to facilitate description. For a more detailed description of such common structure, attention is directed to the preceding description of heat exchanger 20.

Heat exchanger 200 has a plurality of first passages 24 arranged in alternating relationship with second passages 26, and a plurality of plates 30 and 32 which define passages 24 and 26. Dimples 50 are provided on plates 30 and dimples 52 are provided on plates 32. Inlet port 102 is provided for introduction of first fluid 25, inlet port 148 is provided for introduction of second fluid 27, outlet port 106 is provided for removal of the first fluid and outlet port 150 is provided for the removal of the second fluid. Heat exchanger 200 also includes a mid-section 132 which does not extend to the periphery of the heat exchanger. The dimensions, arrangement, number and other aspects of these elements of heat exchanger 200 are described above in connection with the description of heat exchanger 20.

Heat exchanger 200 also includes a central plenum 215 that is preferably concentric with axis 22. First passages 24 positioned beneath mid-section 132 are fluidly coupled with central plenum 215 at their radially inner ends via outlets 217, and first passages 24 positioned above mid-section 132 are fluidly coupled with the central plenum at their radially inner ends via inlets 219. Plates 30 and 32 are folded at radially outer portions and are brazed together to form sealing structure 221. The latter blocks flow of first fluid 25 at radially outermost portions of first passages 24. Adjacent sealing structures 221 are folded and brazed together so as to form sealing structures 223, which block the flow of second fluid 27 at radially outermost portions of second passages 26. Plates 30 and 32 are folded to radially inner portions and are brazed together to form sealing structure 225. The latter blocks flow of first fluid 25 in first passages 24.

First passages 24 are fluidly coupled with one another at radially outer locations via annular bosses 227 provided in radially outer portions of passages 26. Each boss 227 includes an internal aperture 229 which fluidly couples first passages 24 to adjacent first passages 24 and bosses 227. When the plates are brazed together, a fluid-tight seal is made around aperture 229. Bosses 227 are designed to prevent second fluid 27 in second passages 26, through which the bosses extend, from entering apertures 229, and hence first passages 24.

Second passages 26 are fluidly coupled with one another at radially inner locations via annular bosses 233 provided in radially inner portions of passages 24. Each boss 233 includes an internal aperture 235 which fluidly couples second passages 26 to adjacent second passages 26 and bosses 233. When the plates are brazed together, a fluid-tight seal is made around aperture 235. Bosses 233 are designed to prevent first fluid 25 in first passages 24, through which the bosses extend, from entering apertures 235, and hence second passages 26. An annular passage 236 is provided in manifold 238 positioned in mid-section 132 for transporting second fluid 27 through the mid-section. Annular passage 236 is fluidly coupled with second passage 26 immediately below mid-section 132 and with aperture 235 of boss 233 immediately above the mid-section.

Second passages 26 are also fluidly coupled with one another at radially outer locations via annular bosses 237 provided in radially outer portions of first passages 24. Each boss 237 includes an internal aperture 239 which fluidly couples second passages 26 to adjacent second passages 26 and bosses 237. When the plates are brazed together, a fluid-tight seal is made around aperture 239. Bosses 237 are designed to prevent first fluid 25 in first passages 24, through which the bosses extend, from entering apertures 239, and hence second passages 26.

Heat exchanger 200 includes an annular member 251 at the uppermost portion of the heat exchanger. Annular member 251 has a hollow annular region 253 and a hollow annular region 255 positioned adjacent, but radially outward of, region 253. Region 253 is fluidly coupled with outlet port 106 and region 255 is fluidly coupled with outlet port 150. Heat exchanger 200 further includes an annular member 257 at the lowermost portion of the heat exchanger. Annular member 257 has a hollow annular region 259 and a hollow annular region 261 positioned adjacent, but radially outward of, region 259. Region 259 is fluidly coupled with inlet port 102 and region 261 is fluidly coupled with inlet port 148.

Annular member 251 includes a plurality of apertures 263, each fluidly coupling region 253 with an associated one of bosses 227 positioned adjacent the apertures. Annular member 251 also includes a plurality of apertures 265, each fluidly coupling region 255 with an associated one of second passages 26. Annular member 257 includes a plurality of apertures 267, each fluidly coupling region 259 with an associated one of first passages 24 positioned adjacent the apertures. Annular member 257 also includes a plurality of apertures 269, each fluidly coupling region 261 with an associated one of bosses 237 positioned adjacent the apertures.

As described, heat exchangers 20 and 200 include two fluid circuits, one defined by first passages 24 and a second defined by second passages 26. However, the present invention encompasses three, four or more fluid circuits. This is achieved by adding additional fluid passages and associated inlets and outlets, with the additional passages being interleaved with first passages 24 and second passages 26. Bosses similar to bosses 126, 160 and 170 are used to fluidly couple the additional fluid passages, while fluidly isolating the passages from first passages 24 and 26 and other fluid passages. In addition, more than one mid-section 132 may be provided, with first passages 24 and second passages 26 provided on both sides of all mid-sections.

As described below with respect to heat exchanger 20, fluids are introduced into inlet port 102 and inlet port 148, and are removed from outlet port 106 and outlet port 150, resulting in counterflow fluid transport. The placement of inlet ports 102 and 106 may be reversed, or the direction in which fluid is introduced to the ports may be reversed, to achieve parallel fluid flow, also as discussed below. The same is true with respect to outlet ports 148 and 150. With respect to heat exchanger 200, a similar reversal of inlet and outlet ports is contemplated by the present invention, changing the parallel flow paths of first fluid 25 and second fluid 27 to counterflow paths.

In many applications it is advantageous to include first passages 24 and second passages 26 both above and below mid-section 132, as illustrated and described above. With this arrangement, as described in more detail below, first fluid 25 and second fluid 27 flow radially in a first direction, then axially across mid-section 132, and then radially in a second direction opposite the first direction. However, in some applications it will be desirable to modify heat exchangers 20 and 200 so that it includes only first passages 24 and second passages 26 positioned on one side of mid-section 132, i.e., either above or below the mid-section. In this variation, first fluid 25 and second fluid 27 only flow radially in one direction with respect to central axis 22, i.e., toward or away from the central axis. The placement of inlet ports 102 and 148 and outlet ports 106 and 150 is modified so that if a given fluid is introduced at a radially inner location it is removed at a radially outer location, and vice versa.

Figure 6:
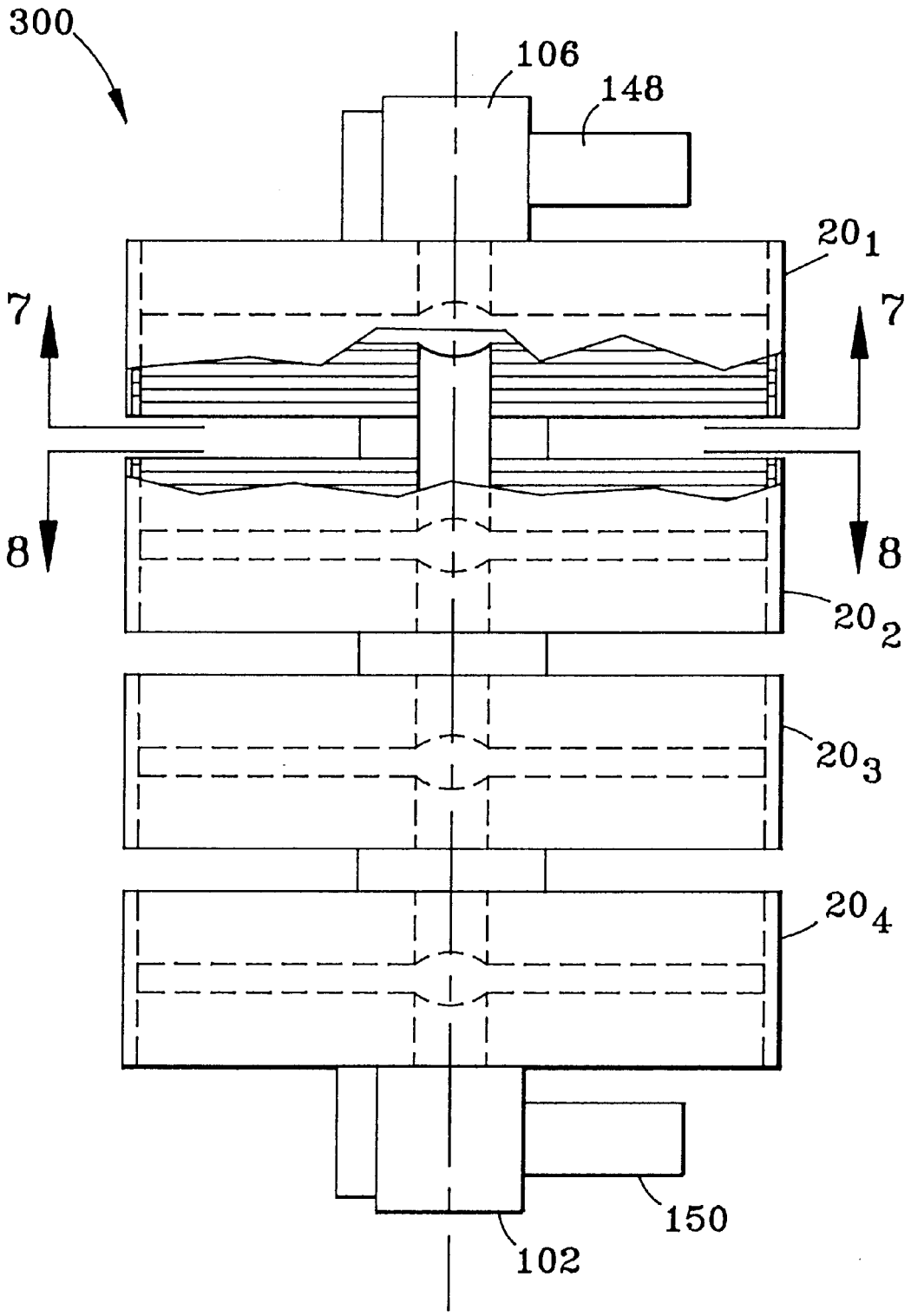
FIG. 6 is cross-sectional view of a modular heat exchange assembly incorporating the radial flow heat exchangers of the present invention.
Figure 7:
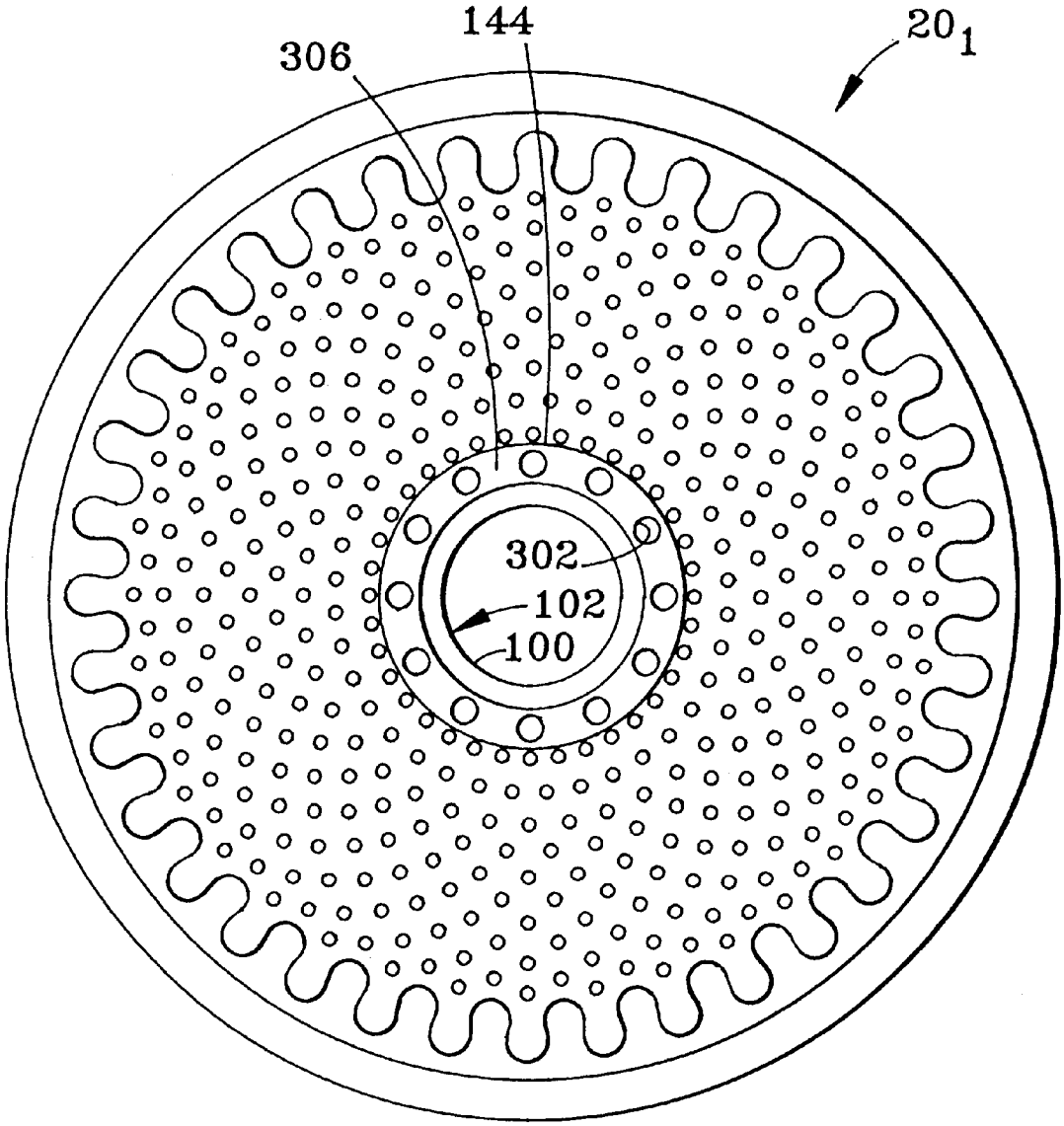
FIG. 7 is a plan view of the bottom surface of the top heat exchanger of the assembly of FIG. 6.
Figure 8:
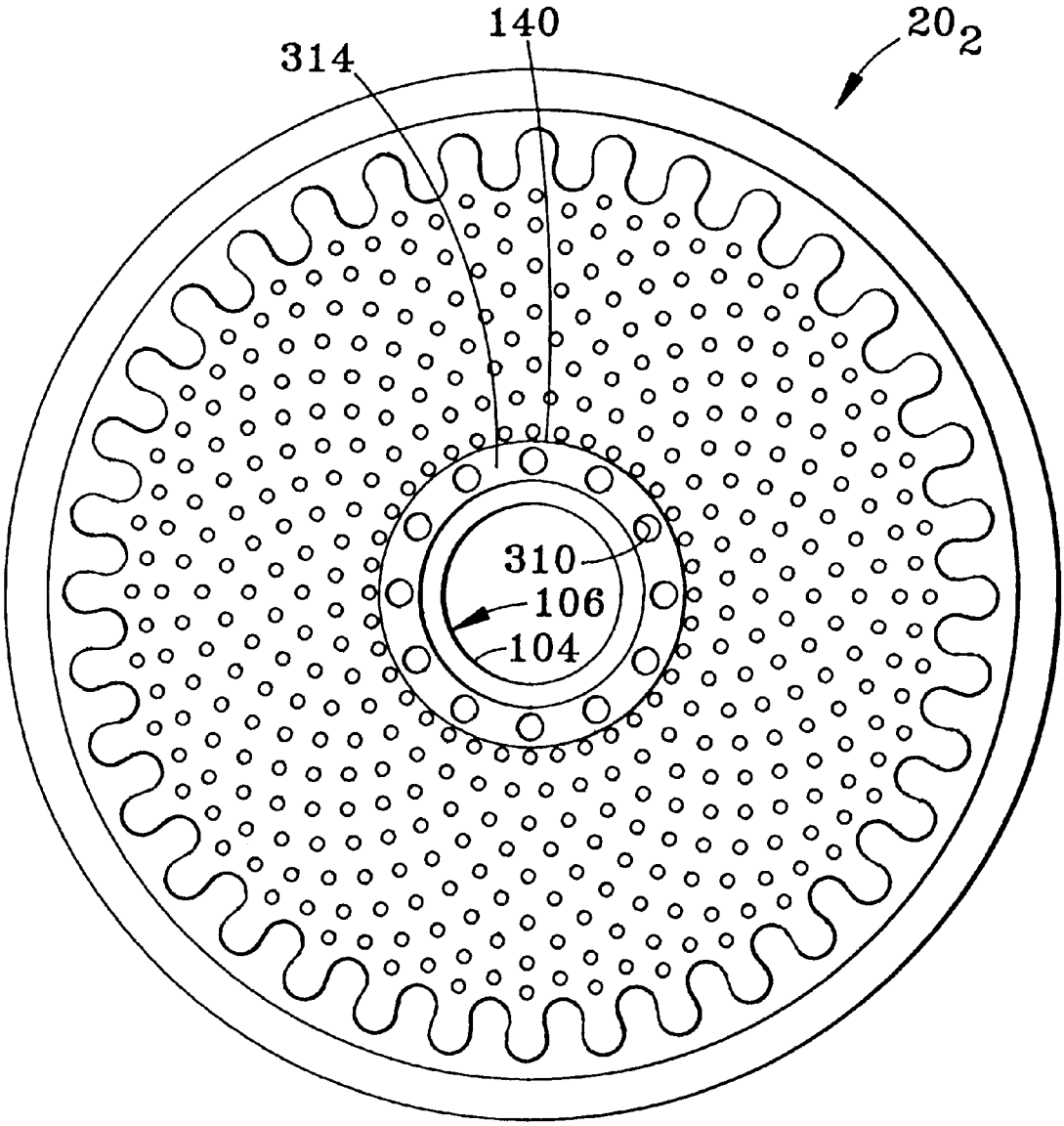
FIG. 8 is a plan view of the top surface of the second heat exchanger of the assembly of FIG. 6.

Turning now to FIGS. 6–8, another aspect of the present invention is modular heat exchange assembly 300. The latter includes a plurality of heat exchangers 20 that are serially fluidly coupled so as to form modular heat exchange assembly 300. For purposes of description, heat exchange assembly 300 illustrated in FIGS. 6–8 includes four heat exchangers 20, labeled $\mathbf{20}_1$, $\mathbf{20}_2$, $\mathbf{20}_3$, and $\mathbf{20}_4$, all coaxially aligned along their respective axes 22. Heat exchange assembly 300 may include more or less than four heat exchangers 20, as the application demands. Inlet port 102 of one heat exchanger, e.g., heat exchanger $\mathbf{20}_1$, and outlet port 106 of an adjacent heat exchanger, e.g., heat exchanger $\mathbf{20}_2$, are fluidly coupled. Similarly, inlet port 148 of one heat exchanger, e.g., heat exchanger $\mathbf{20}_1$, and outlet port 150 of an adjacent heat exchanger, e.g., heat exchanger $\mathbf{20}_2$, are fluidly coupled. By this fluid coupling, first passages 24 of all heat exchangers 20 in heat exchange assembly 300 form a single fluid circuit for transporting first fluid 25, and second passages 25 of all heat exchangers in the heat exchange assembly form a single fluid circuit for transporting second fluid 27.

Referring to FIGS. 2 and 6–8, slight modifications in most of the inlet ports 102 and 148, annular inlet manifolds 140, annular outlet manifolds 144, and outlet ports 106 and 150 are needed to permit heat exchangers 20 to be fluidly coupled in modular fashion to form heat exchange assembly 300. However, outlet port 106, inlet manifold 140 and inlet port 148 of the uppermost heat exchanger, e.g., heat exchanger $\mathbf{20}_1$, and inlet port 102, outlet manifold 144 and outlet port 150 of the lowermost heat exchanger, e.g., heat exchanger $\mathbf{20}_2$, are unmodified.

Describing the modifications, in place of outlet ports 150, a plurality of apertures 302 (FIG. 7) are provided extending through annular outlet manifold 144 so as to be fluidly coupled with its annular interior 146. Manifolds 140 and 144 are preferably formed by an embossment in the outermost plates of heat exchanger 200. In addition, inlet port 102 is shortened so that it does not extend outwardly beyond outer surface 306 of manifold 144. In place of inlet port 148, a plurality of apertures 310 (FIG. 8) are provided extending through manifold 140 so as to fluidly couple second passage 26 in heat exchanger $\mathbf{20}_1$ with second passage 26 in heat exchanger $\mathbf{20}_2$. The number, relative placement and size of apertures 310 is identical to the number, relative placement and size of apertures 302. In addition, outlet port 106 is shortened so that it does not extend outwardly beyond outer surface 314 of manifold 140. Also, inlet port 102 and outlet port 106 have substantially identical inside and outside diameters, With these modifications, when heat exchanger $\mathbf{20}_1$ is positioned relative to heat exchanger $\mathbf{20}_2$ so that the axes 22 of the heat exchangers are aligned and surface 306 of manifold 144 contacts surface 314 of manifold 140, first passages 24 and second passages 26 of heat exchanger $\mathbf{20}_1$ are fluidly coupled, respectively, with the first and second passages of heat exchanger $\mathbf{20}_2$.

More particularly, when heat exchangers $\mathbf{20}_1$ and $\mathbf{20}_2$ are arranged in such mating relationship, second fluid passages 26 of heat exchanger $\mathbf{20}_1$ are fluidly coupled with second fluid passages 26 of heat exchanger $\mathbf{20}_2$ via apertures 310 and 302 which are aligned with one another by virtue of the identical number, relative placement and size of the apertures. Because inlet port 102 and outlet port 106 have identical diameters, they fluidly communicate when heat exchanger $\mathbf{20}_1$ and heat exchanger $\mathbf{20}_2$ are positioned in mating relationship as described above and illustrated in FIG. 6, and fluidly couple first passage 24 in heat exchanger $\mathbf{20}_1$ with first passage 24 in heat exchanger $\mathbf{20}_2$.

Adjacent heat exchangers 20 in heat exchange assembly 300 are secured together, following placement in the confronting relationship described above and illustrated in FIG. 6, by brazing or otherwise securing together adjacent manifolds 140 and 144. Tabs or other alignment devices (not shown) are typically provided in peripheral portions of plates 30 and 32 to aid in assembly.

While heat exchange assembly 300 has been described as including heat exchangers 20, it is to be appreciated that heat exchanger 200, and the variations on such heat exchangers described above, may be used in the heat exchange assembly. Furthermore, in certain applications, e.g., where properties of the fluids transported in heat exchange assembly 300 change during travel through the assembly, it may be desirable to modify certain key parameters of one or more heat exchangers 20 in the assembly. For example, it may be desirable to increase or decrease height δ, increase or decrease the number of dimples 50 and 52 in a given surface area unit, change the outer diameter of the heat exchangers, increase or decrease the number of passages 24 and 26, and/or change materials used in the construction of the heat exchangers.

Referring to FIGS. 1–4, in the following description of the operation of heat exchanger 20, the passage of a first fluid 25 and a second fluid 27 through the heat exchanger will be considered. For the purpose of this operational description of heat exchanger 20, but not as a restriction on the operation of the device, first fluid 25 has a lower pressure and temperature than second fluid 27.

First fluid 25 is introduced via inlet port 102 along a flow path extending substantially parallel to axis 22 into plenum 100. Because plate 112 blocks the upward flow of first fluid 25, the first fluid flows through inlets 114 into those first passages 24 positioned below mid-section 132. First fluid 25 then flows radially outwardly, relative to axis 22, in first passages 24 until encountering sealing structure 120 at the radially outermost ends of the first passages. Because continued radially outward flow of first fluid 25 is blocked by sealing structures 120, the first fluid is forced to flow upwardly through bosses 126 positioned below mid-section 132, through interior aperture 131 in central manifold 130, through bosses 126 positioned above the mid-section and into passages 24 positioned above the mid-section. Because first fluid 25 in bosses 126 is fluidly isolated relative to second passages 26, no mixing with second fluid 27 in the second passages occurs. Next, first fluid 25 flows radially inwardly through passages 24, exits the passages via outlets 116, flows upwardly through plenum 104 and exits heat exchanger 20 through outlet port 106. Plate 110 prevents first fluid 25 from flowing other than through plenum 104 to outlet 106.

Second fluid 27 is introduced radially, relative to axis 22, into interior 142 of annular inlet manifold 140 via inlet port 148. Second fluid 27 travels circumferentially within interior 142 and then flows downwardly through apertures 164, into bosses 160', and then into other bosses 160 positioned above mid-section 132 and into second passages 26 positioned above the mid-section. Because downward travel of second fluid 27 is ultimately blocked by the plate 110 positioned directly above mid-section 132, the second fluid is caused to flow radially outwardly, relative to axis 22, through second passages 26 until sealing structures 122. Then, second fluid 27 is forced downwardly through bosses 170, through interior aperture 176 in central manifold 174 and into second passages 26 and bosses 170 positioned below mid-section 132. Next, second fluid 27 flows radially inwardly through second passages 26 until sealing structures 124, and is then caused to flow downwardly through bosses 160. Then, second fluid 27 flows out bosses 160", through apertures 166 and into interior 146 of annular outlet manifold 144. Finally, second fluid 27 flows circumferentially within interior 146 until reaching outlet port 150 where it is exhausted from heat exchanger 20 in a radial direction relative to axis 22. Thus, second fluid 27 flows through heat exchanger 20 in the opposite direction of flow for first fluid 25, i.e., the first and second fluids have a counterflow relationship.

As the relatively cool first fluid 25 travels through heat exchanger 20 in first passages 24, heat energy from relatively warm second fluid 27 in second passages 26 is transferred to the first fluid as a result of the adjacent, alternatingly stacked relationship of the first and second passages. As the temperature of first fluid 25 is increased and the temperature of second fluid 27 is decreased by this transfer of thermal energy, the temperatures of the first fluid at outlet port 106 approaches the temperature of the second fluid at inlet port 148. Design features of heat exchanger 20 permit an extremely high, i.e., greater than 99%, thermal effectiveness with very low pressure loss, to be achieved with the heat exchanger of the present invention, as described below. As noted above, thermal effectiveness is the ratio of temperature differences between first fluid 25 at inlet port 102 and outlet port 106 to temperature differences between first fluid 25 at inlet port 102 and second fluid 27 at inlet port 148.

Simultaneous high thermal effectiveness and low pressure drop of heat exchanger 20 is achieved, in part, because first fluid 25 and second fluid 27 pass through first passage 24 and second passage 26 with substantially laminar flow when heights $\delta_1$ and $\delta_2$ are selected as described above. As such, dimples 50 and 52 are provided for securing together adjacent plates 30 and 32, and not for creating turbulent flow, as is the case for prior art heat exchangers having dimpled plates, i.e., heat exchangers of the type disclosed in U.S. Pat. Nos. 2,281,754 to Dalzell and 2,596,008 to Collins. Laminar flow is preferred in heat exchanger 20 of the present invention because, contrary to conventional thinking as indicated in these patents, and unlike known heat exchangers, it has been determined that laminar flow produces the maximum heat transfer per unit pressure drop. In addition, highly efficient heat transfer between closely spaced fluid passages 24 and 26, i.e., having heights $\delta_1$ and $\delta_2$ respectively, within the dimensional range described above, permits use of shorter fluid flow paths which reduces pressure drop. Because materials having relatively low thermal conductivity are used in the construction of heat exchanger 20, these shorter fluid flow lengths can be accommodated without a significant penalty in thermal effectiveness arising from flow-direction thermal conduction.

Low cross-flow (i.e., flow between adjacent passages 24 and 26) thermal resistance is additionally achieved through the use of thin flow passages 24 and 26 (i.e., passages having heights $\delta_1$ and $\delta_2$ within the dimensional range listed above), and is also achieved through the use of relatively thin plates 30 and 32. The heat transfer coefficient in laminar flow is inversely proportional to the channel spacing. Therefore closely spaced channels lead to high heat coefficients which maximizes heat transfer per unit of cross stream contact area.

Another design feature of the heat exchanger 20 contributing to its high thermal effectiveness is the configuration and relative placement of first passages 24 and second passages 26. By virtue of the arrangement of first passages 24, second passages 26, bosses 126, bosses 160 and bosses 170 described above, the flow paths of first fluid 25 and second fluid 27 are highly convoluted, i.e., these fluids flow in alternating axial, radial, axial, radial and axial directions, relative to axis 22. This convoluted flow arrangement provides a relatively long flow path for first fluid 25 and second fluid 27, given the dimensions of heat exchanger 20, discussed above. In addition, the relative arrangement of first passages 24 and second passages 26 results in each first passage 24 confronting a second passage 26 substantially along its entire length, and vice versa. As a result of this configuration and relative placement of first passages 24 and second passages 26, there is significant opportunity for transfer of thermal energy between first fluid 25 and second fluid 27 within the confines of a relatively compact heat exchanger.

The design features contributing to the relatively high thermal effectiveness of heat exchanger 20 discussed above also result in relatively high thermal resistance in the direction of fluid flow. High thermal resistance in the direction of fluid flow is advantageous because streamwise heat conduction is a significant performance penalty for high-effectiveness heat exchangers. The absence of fin or plate structures within passages 24 and 26, which are often used in prior art heat exchangers, also increases thermal resistance in the direction of fluid flow. Furthermore, manufacturing plates 30 and 32 from thin foils of material having a relatively low thermal conductivity, e.g., stainless steel, titanium, or certain nickel alloys, increases thermal resistance in the direction of fluid flow.

It is preferred that first fluid 25 and second fluid 27 be transported in a counterflow manner, as described above and illustrated in FIG. 2, to maximize thermal energy transfer between the first and second fluids. However, in certain circumstances, it may be desirable to introduce first fluid 25 and second fluid 27 into heat exchanger 20 so they travel in parallel. In this regard, first fluid 25 is introduced into outlet port 150 and is removed from inlet port 148 (in this mode of operation the terms "inlet" and "outlet" do not refer to fluid flow direction, but only serve as a name for the structure).

Turning now to FIG. 5, heat exchanger 200 operates much like heat exchanger 20 described above, except that first fluid 25 and second fluid 27 flow in parallel, and the fluids are introduced to and removed from a peripheral location rather than a central location on the heat exchanger (although heat exchanger 200 may be modified to permit counterflow fluid transport, as described above). In this regard, first fluid 25 is introduced via inlet port 102 into region 259 of annular member 257. First fluid 25 flows circumferentially within region 259 and then passes through apertures 267 in annular member 257 into first passages 24, directly and via bosses 227. Next, first fluid 25 flows radially inwardly through first passages 24, out outlets 217 and into central plenum 215. Then, first fluid 25 flows upwardly and through inlets 219 into first passages 24 above mid-section 132, and then flows radially outwardly. First fluid 25 then flows upwardly through bosses 227 positioned above mid-section 132, through apertures 263 and into region 253 in annular member 251. First fluid 25 then flows circumferentially within region 253 until reaching outlet port 106 where it is removed from heat exchanger 200.

Second fluid 27 is introduced via inlet port 148 into region 261 of annular member 257. Second fluid 27 flows circumferentially within region 261 and then passes through apertures 269 in annular member 257 into second passages 26, directly and via bosses 237. Next, second fluid 27 flows radially inwardly through second passages 26 until reaching sealing structure 225 at which point the second fluid is forced upwardly through bosses 233 and then through annular passage 236 that passes through mid-section 132. Second fluid 27 then enters second passages 26 above mid-section 132 and flows radially outwardly until reaching sealing structure 223. Then, second fluid 27 travels upwardly through bosses 237 positioned above mid-section 132, through apertures 265 and into region 255 in annular member 251. Second fluid 27 then flows circumferentially within region 255 until reaching outlet port 150 where it is removed from heat exchanger 200.

The operation of each heat exchanger in heat exchange assembly 300 is identical to that described above for heat exchangers 20 and 200. First fluid 25 and second fluid 27 pass between adjacent heat exchangers in heat exchange assembly 300 in the manner described above, thereby extending the path of the first and second fluids as a function of the number of heat exchangers in included in the heat exchange assembly. By changing the construction of different heat exchangers in the modular assembly, performance can be optimized to account for changes in fluid properties between the inlet and the outlet. For example, in cryogenic applications, the cold gas stream has a much higher density than the warm stream. In this case it would be advantageous to decrease the plate spacing $\delta$, at the cold end of the heat exchanger to take advantage of higher heat transfer coefficient with minimal pressure drop penalty.

First passages 24 positioned above and below mid-section 132, are both referred to as "first passages," and second passages 26 above and below mid-section 132 are both referred to as "second passages." However, as an alternative way to describe the present invention, in certain of the claims first passages 24 on one side of mid-section 132 are referred to as "first passages" and first passages 24 on an opposite side of mid-section 132 are referred to as "second passages." In addition, second passages 26 on one side of mid-section 132 are referred to as "third passages" and second passages 26 on an opposite side of mid-section 132 are referred to as "fourth passages."

Because certain changes may be made in the above apparatus without departing from the scope of the present invention, it is intended that all matter contained in the preceding description or in the accompanying drawings shall be interpreted in an illustrative and not in a limiting sense.

What is claimed is:

1. A radial flow heat exchanger comprising:

a. a longitudinal axis;

b. a plurality of first passages for transporting a first fluid;

c. a plurality of second passages for transporting said first fluid;

d. a plurality of third passages for transporting a second fluid;

e. a plurality of fourth passages for transporting said second fluid;

f. wherein each of said first plurality of passages, said second plurality of passages, said third plurality of passages and said fourth plurality of passages surround said longitudinal axis and extend in a direction so as to have a radial change in direction, as measured along radii of said longitudinal axis, divided by a tangential change in direction, as measured tangentially to said radii, that is greater than 10%; and g. further wherein at least one passage in said first plurality of passages, said second plurality of passages, said third plurality of passages and said fourth plurality of passages is constructed such that a first interior portion in said at least one passage lying along a first axis within said at least one passage extending radially to said longitudinal axis is in fluid communication along a major portion of its length with a second interior portion in said at least one passage lying along a second axis within said at least one passage extending radially to said longitudinal axis, with said first axis and said second axis subtending an angle of at least 10°.

2. A radial flow heat exchanger according to claim 1, further comprising:

a. a plurality of fifth passages fluidly coupling said plurality of first passages with said plurality of second passages and extending parallel to said longitudinal axis; and b. a plurality of sixth passages fluidly coupling said plurality of third passages with said plurality of fourth passages and extending parallel to said longitudinal axis.

3. A radial flow heat exchanger according to claim 1, further wherein said plurality of first passages and said plurality of second passages are fluidly coupled and are arranged so that said first fluid is transported, relative to said longitudinal axis, in a first direction in said plurality of first passages and in a second, opposite, direction in said plurality of second passages.

4. A radial flow heat exchanger according to claim 3, wherein said plurality of third passages and said plurality of fourth passages are fluidly coupled and are arranged so that said second fluid is transported relative to said longitudinal axis, in a third direction in said plurality of third passages and in a fourth, opposite, direction in said plurality of fourth passages.

5. A radial flow heat exchanger according to claim 4, wherein said plurality of first passages, said plurality of second passages, said plurality of third passages and said plurality of fourth passages are arranged so that said first direction and said third direction are identical and said second direction and said fourth direction are identical.

6. A radial flow heat exchanger according to claim 4, wherein said plurality of first passages, said plurality of second passages, said plurality of third passages and said plurality of fourth passages are arranged so that said first direction and said fourth direction are identical and said second direction and said third direction are identical.

7. A radial flow heat exchanger according to claim 1, wherein said plurality of first passages and said plurality of fourth passages are interleaved so that each of said plurality of first passages is adjacent and in thermal communication with a corresponding respective one of said plurality of fourth passages, and wherein said plurality of second passages and said plurality of third passages are interleaved so that each of said plurality of second passages is adjacent and in thermal communication with a corresponding respective one of said plurality of third passages.

8. A radial flow heat exchanger according to claim 1, further comprising:

a. a first inlet fluidly coupled with said plurality of first passages through which said first fluid is introduced into said plurality of first passages, and a first outlet fluidly coupled with said plurality of second passages through which said first fluid is removed from said plurality of second passages;

b. a second inlet fluidly coupled with said plurality of third passages through which said second fluid is introduced into said plurality of third passages, and a second outlet fluidly coupled with said plurality of fourth passages through which said second fluid is removed from said plurality of fourth passages; and c. wherein said first inlet and said first outlet are positioned radially inwardly of radially inner ends of said plurality of first passages and said second inlet and said second outlet are positioned radially inwardly of radially inner ends of said plurality of third passages.

9. A radial flow heat exchanger according to claim 1, further comprising:

a. a first inlet fluidly coupled with said plurality of first passages through which said first fluid is introduced into said plurality of first passages, and a first outlet fluidly coupled with said plurality of second passages through which said first fluid is removed from said plurality of second passages;

b. a second inlet fluidly coupled with said plurality of third passages through which said second fluid is introduced into said plurality of third passages, and a second outlet fluidly coupled with said plurality of fourth passages through which said second fluid is removed from said plurality of fourth passages; and c. wherein said first inlet and said first outlet are positioned radially outwardly of radially outer ends of said plurality of first passages and said second inlet and said second outlet are positioned radially outwardly of radially outer ends of said plurality of third passages.

10. A radial flow heat exchanger according to claim 1, wherein at least one of said plurality of first passages, said plurality of second passages, said plurality of third passages or said plurality of fourth passages has a height δ that is no more than 0.5 mm±0.01 mm and is defined by two plates of material without any intervening plates of material.

11. A radial flow heat exchanger according claim 1, wherein said plurality of first passages, said plurality of second passages, said plurality of third passages and said plurality of fourth passages have a height δ that is no more than 0.5 mm±0.01 mm and are each defined by two plates of material without any intervening plates of material.

12. A radial flow heat exchanger according to claim 1, wherein at least one of said plurality of first passages, said plurality of second passages, said plurality of third passages and said plurality of fourth passages, when designed to transport a first fluid having a first density ρ (kg/m$^3$) and a first viscosity $\mu$ (Pa-s) so that said first fluid has a local velocity u (m/s) and a first Reynolds number $Re_t$ that corresponds to the laminar/turbulent transition for said first fluid, has a height δ that satisfies the constraint $$\delta < \frac{\mu Re}{2\rho u}.$$

13. A radial flow heat exchanger according to claim 12, wherein:

a. when said first plurality of passages is designed to transport a first fluid having a first density ρ (kg/m$^3$) and first viscosity $\mu$ (Pa-s) so that said first fluid has a first local velocity u (m/s) and a first Reynolds number $Re_t$ that corresponds to the laminar/turbulent transition for said first fluid, said plurality of first passages have a first height $\delta_1$ that satisfies the constraint $$\delta_1 < \frac{\mu Re_t}{2\rho u}$$

b. when said second plurality of passages is designed to transport a second fluid having a second density ρ (kg/m$^3$) and second viscosity $\mu$ (Pa-s) so that said second fluid has a second local velocity u (m/s) and a second Reynolds number $Re_t$ that corresponds to the laminar/turbulent transition for said second fluid, said plurality of second passages have a second height $\delta_2$ that satisfies the constraint $$\delta_2 < \frac{\mu Re_t}{2\rho u};$$

c. when said third plurality of passages is designed to transport a third fluid having a third density ρ (kg/m$^3$) and third viscosity $\mu$ (Pa-s) so that said third fluid has a third local velocity u (m/s) and a third Reynolds number $Re_t$ that corresponds to the laminar/turbulent transition for said third fluid, said plurality of third passages have a third height $\delta_3$ that satisfies the constraint $$\delta_3 < \frac{\mu Re_t}{2\rho u};$$

d. when said fourth plurality of passages is designed to transport a fourth fluid having a fourth density ρ (kg/m$^3$) and fourth viscosity $\mu$ (Pa-s) so that said fourth fluid has a fourth local velocity u (m/s) and a fourth Reynolds number $Re_t$ that corresponds to the laminar/turbulent transition for said fourth fluid, said plurality of fourth passages have a fourth height $\delta_4$ that satisfies the constraint $$\delta_4 < \frac{\mu Re_t}{2\rho u}; \text{ and}$$

e. wherein any one of said first fluid, said second fluid, said third fluid and said fourth fluid may or may not be the same as other ones of said first fluid, said second fluid, said third fluid and said fourth fluid.

14. A radial flow heat exchanger according to claim 1, wherein said plurality of first passages and said plurality of second passages have a height δ', and said plurality of third passages and said plurality of fourth passages have a height δ", further wherein said height δ' is not equal to said height δ".

15. A radial flow heat exchanger according to claim 1, further comprising a plurality of plates, pairs of which define each of said plurality of first passages, each of said plurality of second passages, each of said plurality of third passages and each of said plurality of fourth passages, wherein said plurality of plates are made from a material having a thermal conductivity of less than 20 Watts/meter-K.

16. A radial flow heat exchanger according to claim 1, further comprising a plurality of plates, pairs of which define each of said plurality of first passages, each of said plurality of second passages, each of said plurality of third passages and each of said plurality of fourth passages, wherein each of said plurality of plates has a thickness ranging from 50 $\mu$m to 250 $\mu$m.

17. A modular heat exchange assembly comprising:

a. a first radial flow heat exchanger according to claim 1; and b. a second radial flow heat exchanger according to claim 1.

18. A modular heat exchange assembly according to claim 17, further comprising:

a. coupling means for fluidly coupling said plurality of first passages in said first radial flow heat exchanger with said plurality of second passages in said second radial flow heat exchanger and for fluidly coupling said plurality of third passages in said first radial flow heat exchanger with said plurality of fourth passages in said second radial flow heat exchanger, when said first radial flow heat exchanger and said second radial flow heat exchanger are positioned in mating relationship.

19. A radial flow heat exchanger according to claim 3, wherein said first direction and said second direction extend radially relative to said longitudinal axis.

20. A heat exchanger according to claim 1, wherein said radial change in direction divided by said tangential change in direction is substantially 100%.

21. A radial flow heat exchanger comprising:

a. a longitudinal axis;

b. a plurality of first passages surrounding said longitudinal axis for transporting a first fluid, wherein said first passages are configured to transport said first fluid in a first direction relative to said longitudinal axis, then substantially parallel to said longitudinal axis, and then in a second direction relative to said longitudinal axis, wherein said second direction is opposite said first direction;

c. a plurality of second passages surrounding said longitudinal axis for transporting a second fluid, wherein said second passages are configured to transport said second fluid in a third direction relative to said longitudinal axis, then substantially parallel to said longitudinal axis, and then in a fourth direction relative to said longitudinal axis, wherein said fourth direction is opposite said third direction; and d. wherein each of said plurality of first passages is positioned immediately adjacent, and is in thermal communication with, a corresponding respective one of said plurality of second passages, each of said plurality of first and second passages includes a plurality of inlets and outlets surrounding said longitudinal axis, and (i) at least some of said plurality of inlets or (ii) at least some of said plurality of outlets, for at least some of said plurality of first passages, extend through at least one of said plurality of second passages, but are fluidly isolated from said at least one of said plurality of second passages.

22. A radial flow heat exchanger according to claim 21, wherein said first direction and said third direction are identical and said second direction and said fourth direction are identical.

23. A radial flow heat exchanger according to claim 21, wherein said plurality of first passages and said plurality of second passages are arranged so that said first direction and said fourth direction are identical and said second direction and said third direction are identical.

24. A radial flow heat exchanger according to claim 21, wherein said plurality of first passages and said plurality of second passages are alternatingly interleaved so that each of said plurality of first passages is adjacent and in thermal communication with a corresponding respective one of said plurality of second passages.

25. A radial flow heat exchanger according to claim 21, further comprising:

a. a first inlet fluidly coupled with said plurality of first passages through which said first fluid is introduced into said plurality of first passages, and a first outlet fluidly coupled with said plurality of first passages through which said first fluid is removed from said plurality of first passages;

b. a second inlet fluidly coupled with said plurality of second passages through which said second fluid is introduced into said plurality of second passages, and a second outlet fluidly coupled with said plurality of second passages through which said second fluid is removed from said plurality of second passages; and c. wherein said first inlet and said first outlet are positioned radially inwardly of radially inner ends of said plurality of first passages and said second inlet and said second outlet are positioned radially inwardly of radially inner ends of said plurality of second passages.

26. A radial flow heat exchanger according to claim 22, further comprising:

a. a first inlet fluidly coupled with said plurality of first passages through which said first fluid is introduced into said plurality of first passages, and a first outlet fluidly coupled with said plurality of first passages through which said first fluid is removed from said plurality of first passages;

b. a second inlet fluidly coupled with said plurality of second passages through which said second fluid is introduced into said plurality of second passages, and a second outlet fluidly coupled with said plurality of second passages through which said second fluid is removed from said plurality of second passages; and c. wherein said first inlet and said first outlet are positioned radially outwardly of radially outer ends of said plurality of first passages and said second inlet and said second outlet are positioned radially outwardly of radially outer ends of said plurality of second passages.

27. A radial flow heat exchanger according to claim 21, wherein at least one of said plurality of first passages and said plurality of second passages, have a height δ that is no more than 0.5 mm±0.01 mm and is defined by two plates of material without any intervening plates of material.

28. A radial flow heat exchanger according to claim 21, wherein said plurality of first passages and said plurality of second passages have a height δ that is no more than 0.5 mm±0.01 mm and are each defined by two plates of material without any intervening plates of material.

29. A radial flow heat exchanger according to claim 21, wherein at least one of said plurality of first passages and said plurality of second passages, when designed to transport a first fluid having a first density ρ (kg/m$^3$) and a first viscosity $\mu$ (Pa-s) so that said first fluid has a local velocity u (m/s) and a first Reynolds number $Re_t$ that corresponds to the laminar/turbulent transition for said first fluid, has a height δ that satisfies the constraint $$\delta < \frac{\mu Re_t}{2\rho u}$$

30. A radial flow heat exchanger according to claim 21, further wherein each of said plurality of first passages and each of said plurality of second passages has a height δ that satisfies said constraint $$\delta < \frac{\mu Re_t}{2\rho u}.$$

31. A radial flow heat exchanger according to claim 21, further comprising a plurality of plates, pairs of which define each of said plurality of first passages and each of said plurality of second passages, wherein said plurality of plates are made from a material having a thermal conductivity of less than 20 Watts/meter-K.

32. A radial flow heat exchanger according to claim 21, wherein said plurality of first passages have a height δ' and ones of said plurality of second passages immediately adjacent corresponding respective ones of said plurality of first passages and not separated by more than one layer of material from said corresponding respective ones of said plurality of first passages have a height δ", further wherein said height δ' is not equal to said height δ".

33. A method of exchanging heat between a first fluid and a second fluid, comprising the steps:

a. transporting a plurality of streams of a first fluid in a first direction extending radially with respect to a longitudinal axis, then substantially parallel to said longitudinal axis and then radially to said longitudinal axis in a second direction opposite said first direction;

b. transporting a plurality of streams of a second fluid in a third direction extending radially with respect to said longitudinal axis, then substantially parallel to said longitudinal axis and then radially to said longitudinal axis in a fourth direction opposite said third direction; and c. wherein individual ones of said plurality of streams of said first fluid and said plurality of streams of a second fluid are alternatingly interleaved, as measured along an axis extending parallel to said longitudinal axis, and further wherein said streams of first fluid pass through, but are fluidly isolated from, said streams of second fluid when traveling substantially parallel to said longitudinal axis.

34. A method according to claim 33, wherein said first and second fluids are selected, and said transporting in steps a and b is performed at flow rates selected so that, said plurality of first fluid streams and said plurality of second fluid streams have substantially laminar flow.

35. A method according to claim 33, wherein at least one of said plurality of streams of first fluid is separated from an adjacent one of and said plurality of streams of second fluid by no more than 250 $\mu$m.

36. A radial flow heat exchanger comprising:

a. a longitudinal axis;

b. a plurality of first passages for transporting a first fluid;

c. a plurality of second passages for transporting a second fluid;

d. wherein each of said first plurality of passages and said second plurality of passages surround said longitudinal axis and extend in a direction so as to have a radial change in direction, as measured along radii of said longitudinal axis, divided by a tangential change in direction, as measured tangentially to said radii, that is greater than 10%; and e. further wherein at least one passage in said first plurality of passages and said second plurality of passages is constructed such that a first interior portion in said at least one passage lying along a first axis within said at least one passage extending radially to said longitudinal axis is in fluid communication along a major portion of its length with a second interior portion in said at least one passage lying along a second axis within said at least one passage extending radially to said longitudinal axis, with said first axis and said second axis subtending an angle of at least 10°.

37. A radial flow heat exchanger according to claim 36, wherein said plurality of first passages and said plurality of second passages are interleaved so that each of said plurality of first passages is adjacent and in thermal communication with a corresponding respective one of said plurality of second passages.

38. A radial flow heat exchanger according to claim 36, further comprising:

a. a first inlet fluidly coupled with said plurality of first passages through which said first fluid is introduced into said plurality of first passages, and a first outlet fluidly coupled with said plurality of first passages through which said first fluid is removed from said plurality of first passages, wherein one of said first inlet and said first outlet is positioned radially inwardly of said plurality of first passages and the other one of said first inlet and first outlet is positioned radially outwardly of said plurality of first passages; and b. a second inlet fluidly coupled with said plurality of second passages through which said second fluid is introduced into said plurality of second passages, and a second outlet fluidly coupled with said plurality of second passages through which said second fluid is removed from said plurality of second passages, wherein one of said second inlet and said second outlet is positioned radially inwardly of said plurality of second passages and the other one of said second inlet and second outlet is positioned radially outwardly of said plurality of second passages.

39. A radial flow heat exchanger according to claim 36, wherein at least one of said plurality of first passages and said plurality of second passages has a height δ that is less than 2 mm.

40. A radial flow heat exchanger according to claim 39, wherein at least one of said plurality of first passages and said plurality of second passages has a height δ that is less than 0.5 mm.

41. A radial flow heat exchanger according to claim 36, wherein at least one of said plurality of first passages and said plurality of second passages, when designed to transport a first fluid having a first density ρ (kg/m$^3$) and a first viscosity $\mu$ (Pa-s) so that said first fluid has a local velocity u (m/s) and a first Reynolds number $Re_t$ that corresponds to the laminar/turbulent transition for said first fluid, has a height δ that satisfies the constraint $$\delta < \frac{\mu Re_t}{2\rho u}$$

42. A radial flow heat exchanger according to claim 36, further comprising a plurality of plates, pairs of which define each of said plurality of first passages and each of said plurality of second passages, wherein said plurality of plates are made from a material having a thermal conductivity of less than 20 Watts/meter-K.

43. A heat exchanger according to claim 36, wherein said radial change in direction divided by said tangential change in direction is substantially 100%.

* * * * *

UNITED STATES PATENT AND TRADEMARK OFFICE

CERTIFICATE OF CORRECTION

PATENT NO. : 6,170,568 B1 
APPLICATION NO. : 09/054295
DATED : January 9, 2001
INVENTOR(S) : Javier Valenzuela It is certified that error appears in the above-identified patent and that said Letters Patent is hereby corrected as shown below:

In column 15, line 18, after the word "transported" insert a -- , --.

In column 16, line 42, delete equation " $\delta < \frac{\mu \mathrm{Re}}{2\rho u}$ " and substitute therefor -- $\delta < \frac{\mu \mathrm{Re}_t}{2\rho u}$ --

In column 19, lines 49-55, delete claim 30 in its entirety, and substitute therefor -- A radial flow heat exchanger according to claim 21, further wherein:

a. when said first plurality of passages is designed to transport a first fluid having a first density ρ (kg/m$^3$) and first viscosity μ (Pa-s) so that said first fluid has a first local velocity u (m/s) and a first Reynolds number $\mathrm{Re}_t$ that corresponds to the laminar/turbulent transition for said first fluid, said plurality of first passages have a first height ä$_1$ that satisfies the constraint $$\delta_1 < \frac{\mu \mathrm{Re}_t}{2\rho u} \quad ;$$

b. when said second plurality of passages is designed to transport a second fluid having a second density ρ (kg/m$^3$) and second viscosity μ (Pa-s) so that said second fluid has a second local velocity u (m/s) and a second Reynolds number $\mathrm{Re}_t$ that corresponds to the laminar/turbulent transition for said second fluid, said plurality of second passages have a second height $\delta_2$ that satisfies the constraint $$\delta_2 < \frac{\mu \mathrm{Re}_t}{2\rho u} \quad ; \text{ and}$$

UNITED STATES PATENT AND TRADEMARK OFFICE

CERTIFICATE OF CORRECTION

PATENT NO. : 6,170,568 B1
APPLICATION NO. : 09/054295
DATED : January 9, 2001
INVENTOR(S) : Javier Valenzuela It is certified that error appears in the above-identified patent and that said Letters Patent is hereby corrected as shown below:

c. wherein said first fluid may or may not be the same as said second fluid.--

Signed and Sealed this

Twenty-second Day of January, 2008

JON W. DUDAS
*Director of the United States Patent and Trademark Office*